United States Patent [19]

Hultman

[11] Patent Number: 4,741,103

[45] Date of Patent: May 3, 1988

[54] RAZOR FOR SHAVING A FACE HAVING PSEUDOFOLLICULITIS BARBAE

[75] Inventor: Carl A. Hultman, Derby, Conn.

[73] Assignee: Warner Lambert Company, Morris Plains, N.J.

[21] Appl. No.: 890,992

[22] Filed: Jul. 25, 1986

[51] Int. Cl.[4] ..... B26B 19/42
[52] U.S. Cl. ..... 30/34.2
[58] Field of Search ..... 30/32, 34.2, 52, 81, 30/90

[56] References Cited

U.S. PATENT DOCUMENTS

| | | | |
|---|---|---|---|
| 2,068,085 | 1/1937 | Stanley | 30/34.2 |
| 2,780,862 | 2/1951 | Grathwohl | 30/32 X |
| 3,138,865 | 6/1964 | Meyer | 30/34.2 |
| 3,722,090 | 3/1973 | Dawidowicz | 30/34.2 |
| 3,909,939 | 10/1975 | Dootson | 30/34.2 |
| 4,189,832 | 2/1980 | Harper et al. | 30/34.2 |

*Primary Examiner*—E. R. Kazenske
*Assistant Examiner*—Michael D. Folkerts
*Attorney, Agent, or Firm*—Howard Olevsky; Stephen Raines

[57] ABSTRACT

This invention provides a razor having a knurled guard bar and a single sharp blade particularly adopted for shaving one suffering from pseudofolliculitis barbae.

13 Claims, 2 Drawing Sheets

RAZOR FOR SHAVING A FACE HAVING PSEUDOFOLLICULITIS BARBAE

FIELD OF THE INVENTION

This invention relates to a system with a roughened guard bar and particularly a system adapted to be used by sufferers of pseudofolliculitis barbae (PFB).

BACKGROUND OF THE INVENTION

Razors, whether of the replacement blade/cartridge type or of the disposable variety include a handle, a blade, a support platform or seat upon which the blade rests, a guard bar which is an extension of the platform beyond the cutting edge of the blade positioned below its cutting edge and a cap which protects the top of the blade and aids positioning. Razor systems are used herein refer to both the disposable and replacement blade/cartridge type.

Guard bars protect the face from deep direct cuts by the blade by extending beyond the cutting edge and also serve to control skin flow to the blade in combination with the blades relative position.

The prior art is replete with a variety of guard bar configurations, for example, U.S. Pat. No. 2,548,959 issued to Eisenberg et al describes a guard bar extension of soft resilient rubber for a double edged blade razor designed to stretch the skin to make the whiskers "pop up." This rather complicated construction requires the addition of L-shaped rubber segments which extend from the metal platform used to support the blade.

U.S. Pat. No. 3,138,865 issued to Meyer describes a guard bar for a double edge blade which extends a substantial distance beyond the blade edge. The blade overlays troughs used for gathering shaving debris positioned adjacent the edge of the guard bar with the guard bars themselves forming a series of toothed serrations extending longitudinally about the guard bar circumference from the top to the bottom with the grooves positioned transversely and parallel to the cutting edge.

U.S. Pat. No. 2,374,612 issued to Mellon describes a razor of the double edged blade type having a serrated cap which extends to an area just short of the blade edge and a single line of squared serrations which extends from the platform to form a guard bar jutting beyond the blade edge. The serrations define slots which extend inward from the blade edge and are designed, according to the inventor, to retain water to aid in the lubrication of the face during shaving.

U.S. Pat. No. 2,817,146 issued to Roberts describes a guard bar with an essentially circular profile for a double edge blade. The guard bar which extends substantially beyond the blade cutting edge provides an essentially circular profile for minimum guard bar contact with the face to prevent pressing facial hair down. This guard bar has a transverse groove which is lightly serrated to accentuate this low friction aspect of the guard bar surface contact.

U.S. Pat. No. 2,568,047 issued to Anderson describes a guard bar for double edge razor which is basically a rotating auger.

U.S. Pat. No. 2,766,521 issued to Benvenuti discloses a guard bar having rotating wheels positioned around the common shaft also for a double edge blade.

U.S. Pat. No. 489,832 describes a double edge blade having a guard bar of rather complicated construction which claims the use of hair raising means with barbed ends which are spring mounted on a flange to prevent stretching of the user's skin.

Martin in U.S. Pat. No. 2,300,794 also discloses a guard bar is with a cylinder in a trough which is rotated by facial contact.

One of the more successful guard bar configurations is disclosed in U.S. Pat. No. 3,722,090 issued to Dawidowicz. This patent discloses a guard bar with a plurality of ridges spaced along the upper surface. Each of the ridges has an articulate outer surface extending from the continuous guard bars surface upwardly and inwardly toward the blade such that the upper portion of the ridges is closely proximate to the cutting edges of the blade. These ridges smooth and stretch the skin prior to the skin coming into a cutting engagement with the blade. According to the disclosure of this patent, this skin between the spaced ridges will bow slightly when taut as a result of the smoothing and stretching action of the upper surfaces of the ridges of the guard bar. This action smoothes and stretches skin imperfections such that a minimum amount of skin enters between the guard bar and the cutting edge, thus minimizing the possibility of nicks and cuts.

SUMMARY OF THE INVENTION

According to this invention a razor system with a guard bar having several closely spaced knurls is provided to obtain comparatively high levels of frictional contact between the guard bar and facial skin to subsequently maintain the skin in a stretched, taut condition for maximum hair exposure to the blade element during shaving.

It has been found that maximum frictional contact can be obtained by using at least ten and preferably at least 20 closely spaced knurls per lineal transverse guard bar inch and, in a particularly preferred embodiment these knurls exist in a plurality of rows transversely across the length of the guard bar. The razor system made in accordance with this invention is designed particularly for use with the skin condition known as pseudofolliculitis barbae.

DETAILED DESCRIPTION OF THE INVENTION

PFB, a condition common among black males occurs when a curled hair grows first outward and then back into the skin surface providing a raised roughened area of the point of hair entry. Since the hair is not exposed it cannot be shaved but the raised area provides a site for slicing with a conventional blade razor. The extreme tensioning of the face which occurs from these plurality of closely spaced knurls used in this invention helps to provide an upright profile for the individual hairs to be cut.

Other features of this razor system have been designed to particularly accommodate the difficulties encountered in shaving for those with the PFB condition. For example, the razor system of this invention employs a single blade assembly with defined sharpness characteristics as will be explained more fully below to produce a shave having facial hair with a particular cut profile and length. Also, in a particularly preferred embodiment, the cap has protective fingers which extend essentially to the edge of the shaving blade to control the amount of cutting surface.

DESCRIPTION OF THE DRAWINGS

This invention may be more readily understood by reference to the drawings in which.

Figure 1:
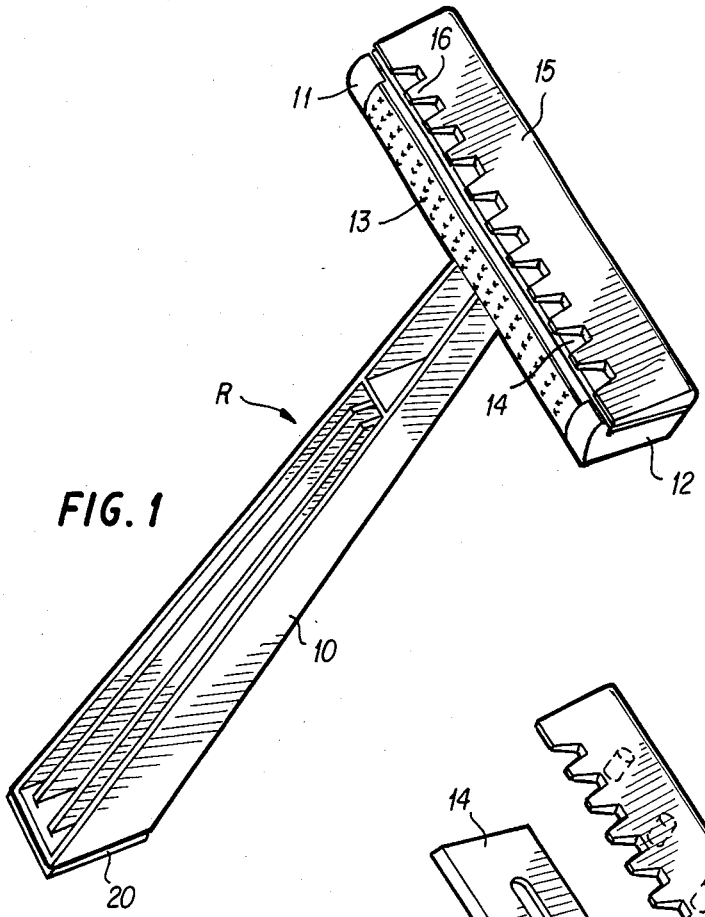
FIG. 1 is a front perspective view of a disposable razor of this invention.

As can be seen with reference to FIG. 1, a razor, according to this invention is provided with a handle 10 which is connected to a supporting platform or blade seat 12 an extension of which forms guard bar 11 having knurl surfaces 13. As can be seen from enlarged view of these knurls at FIG. 3 they consist of a series of closely spaced truncated cones having 4 upwardly tapering sides. These relatively flat, as opposed to arcuate upper, spaced surfaces are found to provide maximum friction for producing the tautness of skin necessary to project the facial hairs in an upright manner. For the knurled configuration to be maximally effective the maximum value of X and Y respectively should not exceed 0.004 in. and should not be less than 0.0005 in. while the angle should be between 30° and 90° and the height of the truncated cone should exceed 0.002 in. The handle 10 seat 12, guard bar 11 and raised knurls 13 are preferably a unitary element molded from a suitable plastic such as polystyrene. As can been seen most clearly from FIG. 2, stakes 17 extending downward from cap 15 engage blade slots 18 in blade 14 through seating holes 19 in blade seat 12.

Figure 4A:
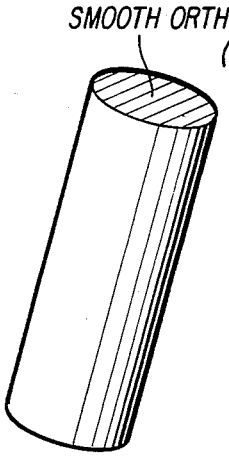
Figure 4C:
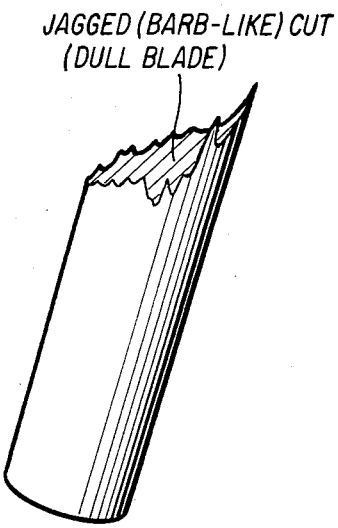
Figure 4B:
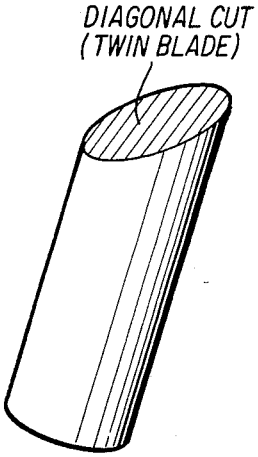

As can been seen by the diagramatic view of hair cut by three types of blades in FIG. 4, only an exceedingly sharp single edged blade, as will be defined below, provides a suitable flat surface to the end of the cut hair due to the orthogonal cut. Due to the action of the twin blade cutting system the profile of the top of the cut hair is curved and actually provides a relatively sharp leading end almost in the form of a barb which easily enters the skin. A dull blade leaves a jagged cut surface which can also hook the skin and more easily penetrate it than the smooth profile provided by the single sharp blade cut.

Sharpness is defined for purposes of this invention as a blade edge having a radius of curvature between 400 and 800 Angstroms and a gothic arch angle of between about 35° to 80°. The radius of curvature is determined by high power magnification. The blade edge under magnification of at least 60,000×— appears as a parabola. The radius is the length of the radius divided by the magnification a value which is ultimately expressed in angstroms with the smaller the angstrom value the narrower the parabola and the sharper the blade. Blade stability and resistance to deformation is determined by the angle of the gothic arch. The gothic arch defines the angle of the sides of the parabola measured, for purposes of this invention from 1.00 micrometers to the ultimate blade tip. This combination of necessary sharpness with blade stability to prevent deformation and/or breaking produces a suitable blade for obtaining the cut depicted in FIG. 4.

Blade exposure of between 0.001 and 0.004 inches has been found to be suitable for the blade of this invention. Exposure is defined as the distance the blade extends beyond a tangent line drawn from the outer most portion of the cap to the outer most portion of the guard bar.

The blade positioning is also defined by span which is the line drawn perpendicularly from the blade to the guard bar at the blade tip. For this invention, a suitable span is between 0.0050 and 0.0065 inches.

Figure 2:
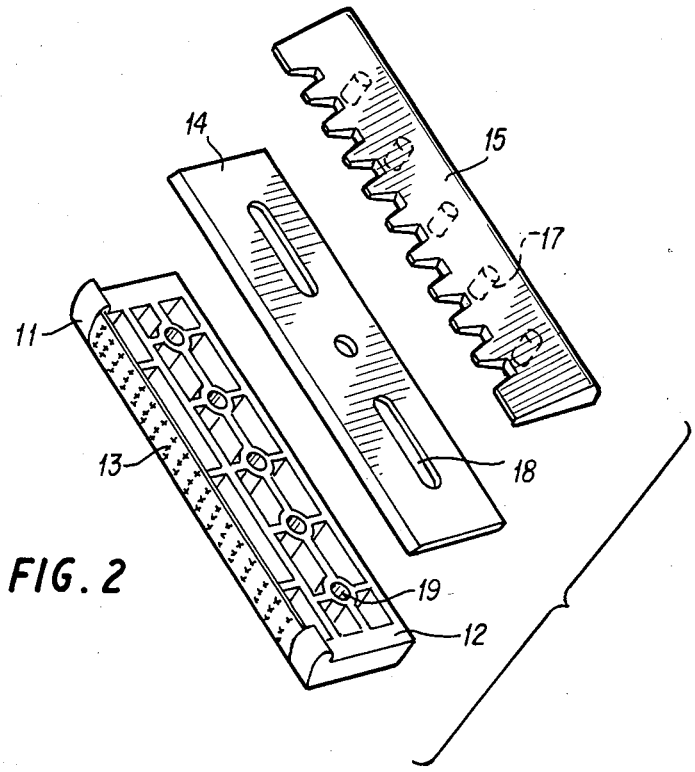
FIG. 2 is an exploded view of the razor head of FIG. 1.
Figure 3:
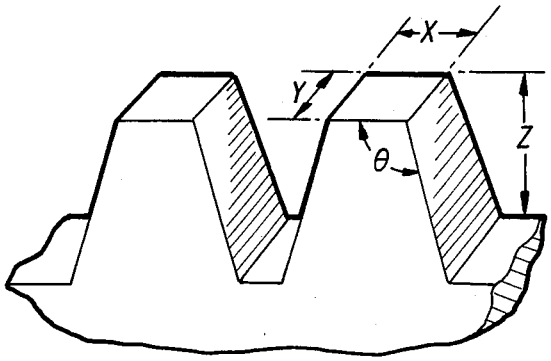
FIG. 3 is a greatly enlarged view of two knurls which make up the guard bar and FIG. 4 is a pictorial representation of photomicrographs of hair which has been cut by a well sharpened twin blade cutting system, a relatively dull single edge cutting system and an extremely sharp single edge blade cutting system. In a particularly preferred embodiment of the subject invention, the PFB razor is designed to cut "high" and sharp while obtaining maximum skin friction to produce the most upright possible angle of facial hair for razor contact.

As can be seen by reference to FIGS. 1 and 2, the cap 15 has fingers 16 which extend near and preferably to the blade edge. This is desirable for a razor adopted to those suffering from PFB because of the extreme sensitivity of the face and is designed to minimize nicks and cuts associated with the continuous exposure of a blade cutting edge.

An added feature of the razor is the addition of a "Velcro" pad 20 which may be positioned as shown in FIG. 1 at the bottom of the razor handle. Not only does the velcro addition serve as a means for mounting the razor but it can also be rubbed over the face prior to shaving to raise the hairs for better exposure to cutting action.

The concept of this invention is to provide a razor which cuts a high percentage of facial hair due to the high friction guard bar, provides a cut hair surface which is substantially smooth and therefore resists repentration into the face and, due to the special relationship of the blade and guard bar and in a preferred embodiment the cap rides over the face at a distance which does not slice open the characteristic bumps associated with PFB condition. Of necessity the blade does not provide the extremely close shave usually desired but does provide an acceptable shave with maximum comfort and minimum ingrown hair resulting.

I claim:

1. Guard bar for a razor comprising at least ten closely spaced knurls, having a series of closely spaced truncated cones having four upwardly tapering sides, per lineal guard bar inch as measured across the long axis of the guard bar, said knurls defining a discontinuous upper surface by their top.

2. The guard bar of claim 1 wherein the knurl has an upper surface defined by sides between 0.004 and 0.0005 in. in length.

3. The guard bar according to claims 1 or 2 wherein the height of the upper surface is at least 0.002 in. as measured from the space between knurls to the top of the knurl.

4. The Guardbar of claim 1 wherein the angle formed by the side and the top of the knurl is between 30° and 90°.

5. A razor system comprising in combination:

(a) A blade assembly with a single blade having a shaving edge;

(b) A handle;

(c) A blade seat for supporting said blade assembly and maintaining said blade at a predetermined shaving angle extending at an angle from the end of said handle and also extending beyond the blade edge to form a guard bar;

(d) Said guard bar having at least 10 closely spaced knurls, having a series of closely spaced truncated cones having four upwardly tapering sides, per lineal inch as measured along the long axis of the guard bar.; and (e) A cap positioned above said blade connected with at least said handle or said blade seat.

6. The razor system according to claim 5 wherein the guard bar has at least twenty closely spaced knurls to the lineal transverse inch.

7. The razor system according to claims 5 or 6 wherein the guardbar has a plurality of transversely extending rows of knurls parallel to said blade shaving edge.

8. The razor system according to claim 5 wherein said cap has fingers extending essentially to the edge of said blade.

9. The razor system according to claim 5 wherein the blade has a radius of curvature between 400 and 800 Angstroms.

10. The razor system according to claims 5 or 9 wherein the blade has a gothic arch angle between about 35° to about 80°.

11. The razor system according to claim 5 wherein velcro patch is provided on said handle.

12. The razor system according to claim 5 wherein the blade exposure is between 0.001 and 0.004 inches.

13. The razor system according to claim 5 wherein the span is between 0.005 and 0.0066 inches.

* * * * *